US010179631B2

(12) United States Patent
Brucker

(10) Patent No.: US 10,179,631 B2
(45) Date of Patent: Jan. 15, 2019

(54) WATER RUNNING TUNNEL HULL SKI

(71) Applicant: Kenneth Brucker, St. Petersburg, FL (US)

(72) Inventor: Kenneth Brucker, St. Petersburg, FL (US)

( * ) Notice: Subject to any disclaimer, the term of this patent is extended or adjusted under 35 U.S.C. 154(b) by 15 days.

(21) Appl. No.: 15/417,919

(22) Filed: Jan. 27, 2017

(65) Prior Publication Data

US 2018/0215448 A1 Aug. 2, 2018

(51) Int. Cl.
*B63B 35/83* (2006.01)
*B63H 16/08* (2006.01)
*A63C 5/00* (2006.01)

(52) U.S. Cl.
CPC ..... *B63B 35/83* (2013.01); *B63H 16/08* (2013.01); *A63C 5/00* (2013.01)

(58) Field of Classification Search
CPC ... B63B 35/83; B63B 35/792; B63B 35/7923; B63B 35/7926; B63B 35/793; B63B 35/81; B63B 35/811; B63B 2035/818; B63B 2001/128; B63B 2001/203; B63H 16/08; A63C 5/00; A63C 5/0417
See application file for complete search history.

(56) References Cited

U.S. PATENT DOCUMENTS

| | | | | |
|---|---|---|---|---|
| 1,834,424 | A | 12/1931 | Rohrmann et al. | |
| 3,063,071 | A * | 11/1962 | Van Vorst | B63B 35/83 441/77 |
| 3,112,504 | A | 12/1963 | Carlton | |
| 3,808,622 | A | 5/1974 | Webster | |
| 4,915,659 | A | 4/1990 | Sanders | |
| 9,248,890 | B2 * | 2/2016 | Raaphorst | B63B 35/7926 |
| 2001/0053642 | A1 | 12/2001 | Chao | |

* cited by examiner

*Primary Examiner* — Andrew Polay
(74) *Attorney, Agent, or Firm* — Larson & Larson, P.A.; Justin P. Miller; Frank Liebenow

(57) ABSTRACT

The disclosed invention is a user-propelled device with no moving parts. The user places a single ski on each foot, the skis being independent from one-another. As the user strides the natural motion of his legs causes the skies to rise and fall with respect to the surface of the water. This rising and falling motion, and the resulting weight shift of the user, engages and disengages a plurality of paddles. Through this natural motion, the paddles are engaged when the foot is moving backward with respect to the user, and disengaged when moving forward with respect to the user. The result is forward motion with a natural gait, with automatic paddle engagement and disengagement.

20 Claims, 10 Drawing Sheets

WATER RUNNING TUNNEL HULL SKI

FIELD

This invention relates to the field of self-propulsion on water and more particularly to a device that allows its user to walk or run on water.

BACKGROUND

Humans have been striving to walk or run on water for centuries. The notebooks of Leonardo Da Vinci in the late 15th century include drawings of soldiers traversing bodies of water to attack unsuspecting enemies.

But despite its appeal, inventors have struggled to create a device that is effective and practical. As a result, the prior art devices that purport to allow humans to walk or run across water are merely curiosities.

What is needed is a device that allows its user to stand, walk, and run on the surface of water while expending only slightly more energy than required to do so on land.

SUMMARY

The disclosed invention is a user-propelled device with no moving parts. The user places a single ski on each foot, the skis being independent from one-another. As the user strides the natural motion of his legs causes the skies to rise and fall with respect to the surface of the water. This rising and falling motion, and the shifting weight of the user, engages and disengages a plurality of paddles. Through this natural motion, the paddles are engaged when the foot is moving backward with respect to the user, and disengaged when moving forward with respect to the user. The result is forward motion with a natural gait, with automatic paddle engagement and disengagement.

Turning to the design of each ski: The disclosed device requires no moving parts for effective operation. The paddles are fixed in place, and do not require hinges. The fixed position of the paddles is enabled by the cyclical upward and downward motion of the skis during use, which works with the buoyancy of the skis and placement of the paddles, to result in natural engagement and disengagement of the paddles and the water.

The lack of hinges increases performance by ensuring that all rearward motion of the skis results in forward propulsion, and increases reliability by minimizing parts that can break or foul.

Each ski has a fixed length, width, and depth. The ski width is chosen to allow the use of the skis with a natural stance, rather than requiring the feet to be spread apart.

In the preferred embodiment, the user's foot is centered left-to-right in each ski. In alternative embodiments, the user's foot is off-center, pushed to either the inside or outside of the ski.

The user's foot connects to the ski through an adapter/boot within a foot well. The foot well is positioned low in each ski to keep user's center of gravity as close to the surface of the water as possible. The user may choose adapters based upon the goal of the user. High performance, lightweight inserts may be chosen for athletic use, or comfortable inserts for casual use.

Understanding the shape of each ski is important to understanding the behavior of a pair of skis during use.

Each ski is formed from two hulls, each hull substantially triangularly shaped. The hulls are oriented such that one side of each triangle forms the ski top, and the two remaining sides form the ski sides. The hypotenuse of each triangular shape faces toward the center of the ski.

The tips of the triangles point down, into the water. As a given ski descends into the water, its buoyancy increases. Given the triangular shape, the buoyancy increase occurs non-linearly. Stated differently, the buoyancy increases at an increasing rate because the volume of the submerged section of each triangle increases by both width and height while being submerged. This is in contrast to, for example, a cube, in which the submerged volume would increase only as a factor of its height, given its constant width.

The triangular shape, and its effect on increasing buoyancy, creates a cushioned feeling as the skis descend into the water.

The added benefit of the shape created by the dual triangles is that the outer width remains consistent, even as the submerged volume increases. This allows each ski to retain stability regardless of how much of the ski is submerged.

Finally, the triangular shape reduces the resistance of the water to forward motion of the skis. As is discussed below, each ski moves forward when it is high in the water, and remains stationary when low in the water. When lifted out of the water, only the lower tip of each triangular hull remains in the water. This lower triangular tip provides a minimized displacement and surface area to resist the flow of water around the ski, thus keeping friction on the advancing ski to a minimum.

But the triangular ski hulls alone cannot propel the user forward. It is the paddles that provide this action.

Each ski includes a series of paddles along the ski centerline, the paddles spaced approximately evenly along the length of the ski. The ski centerline is the space between the dual hulls. Placement of the paddles along the centerline, which in the preferred embodiment is also the center location of the foot well, avoids the creation of torque as the fixed ski is used to push the user forward. The fixed ski, or trailing ski, is the ski the user is using to push against in order to move himself forward.

As is described below, the construction and shape of the dual hulls allows the paddles to be in a fixed position without interfering with the forward motion of the skis during use.

The paddles may be formed in one or more shapes, as viewed from the side of the ski. The paddles may be straight, like a capital letter "I," with an angle of zero degrees with respect to vertical, or it may be at an angle with respect to vertical. The preferred angle is such that the upper end of each paddle is closer to the front of the ski, and the bottom of each paddle closer to the rear.

In the preferred embodiment, the paddles have the shape of a capital letter "C," with the open portion of the C-shape facing toward the rear of the ski.

The benefit of the tilt, or the C-shape open toward the rear, is two-fold. First, the tilt pushes water down during forward motion of the advancing leg which helps to lift the ski out of the water. Second, the tilt minimizes the impact of waves that catch the paddles during forward motion of the ski.

As an additional feature, the tilt of each paddle may be further accentuated near the lower tip of the paddle. This is in recognition of the greater prevalence of smaller waves, for which only the lower portion of the paddle need be tilted.

In the preferred embodiment, the paddles are rigid in order to avoid wasting any energy as the paddles engage the water. In alternative embodiments, the paddles are flexible.

The combination of any two paddles and the dual hulls forms a compartment. During use of the skis, the rise and fall of water inside the compartment pushes against the air that otherwise occupies the space between the paddles and the hulls. The control of this air is another means by which the behavior of each ski is controlled.

In the absence of an escape path for air, as the ski descends into the water, air would be trapped in the compartment formed by the paddles and the hulls. Much like pushing an upside-down drinking glass into water, or lowering a diving bell, the buoyancy of the trapped air would create resistance and prevent the introduction of water into the compartment. This resistance is referred to as "air lock"—a bubble of air that stops the flow of fluid.

In the disclosed device, air lock would prevent the paddles from engaging with the water, and thus prevent the ski from obtaining traction via the paddles descending into the water. The result would be a decrease in efficiency.

By providing an opening or gap above the compartment the trapped air is allowed to exit in a controlled manner, allowing the ski to freely move downward and the compartments to fill with water.

In the preferred embodiment the dual hulls are separated by either a continuous gap, or a series of small gaps/openings along the top of each ski, resulting in a gap/opening at each compartment. The gaps allow air to escape that would otherwise be trapped within each compartment by the rising water.

If desired, the flow of air from the compartment may be throttled or choked in order to lower the rate at which it flows from the compartment. Such control of the air can be used to alter the downward rate of the skis. For a racing ski a quick descent may be desired, whereas for a leisure ski a slower descent may be preferable. Control of the air flow can be by air flow control orifices, or orifices that are sized in order to allow air to pass at a chosen speed. Smaller orifices may be used to decrease the speed of descent, and larger orifices to increase speed.

The features of the ski, such as the vertically increasing profile, controlled exit of air, and natural impact absorption of water, combine to allow walking, running, and jogging without the joint strain one normally experiences while doing so on land.

The rising and falling motion of the skis allows for the use of fixed paddles that engage and disengage the water naturally as the user strides.

Each ski is configured such that the paddles are above the water line during the advancing step—the period of least hydraulic resistance to allow forward motion most easily. The paddles are then fully engaged into the water during the down/rearward step—the period of maximum hydraulic resistance to minimize rearward motion of the non-advancing, or fixed, ski. In order to understand how the device accomplishes this using fixed paddles, one must understand the interaction of waterlines.

A waterline is a line on a vessel to which water will rise, or the vessel will sink, when a certain load is applied. The disclosed device uses two separate skis, each of which acts as a separate vessel. The load applied to each ski varies with the shifting of weight that the user makes during use, much like weight is shifted from foot-to-foot as one walks.

The result of this shifting weight is the rising and falling of each ski. Through proper sizing of the skis, and intentional placement of the paddles, the paddles will exit and enter the water as the user shifts weight. The result is three benchmark waterlines:

Waterline A—level of water's surface on a single ski during the forward motion of that ski;

Waterline B—level of water's surface on both skis when user's weight is evenly distributed across both skis; and Waterline C—level of water's surface on a single ski when user's weight is fully applied to that ski during application of power to the ski.

Waterline A—forward motion position. At this level the ski is essentially unloaded. The water's surface is a set distance below paddle tips. The gap between the paddle tips and the water's surface is designed for small waves to pass beneath the paddles.

Waterline B—neutral position. At this level each paddle is partially engaged in the water. This is the water level at which the skis sit when the user splits his weight across the skis.

Waterline C—power position. If ski size and user's weight are correctly matched, substantially all of each paddle moves down into, and engages with, the water.

Because the depth to which each ski rises and sinks depends on the weight applied by the user relative to ski buoyancy, ski sizing is important. Different size skis are required for users of different weights. By tailoring the sizing of the skis to the user, the ski will rise and fall the intended amount during use, resulting in the waterlines described above.

Furthermore, the proportion of height and width vs. length will affect the behavior of the ski. Assuming a consistent cross-sectional area for a given length and thus buoyancy per unit length, a longer ski will rise more out of the water during a stride, where a shorter ski will rise less. Intentionally choosing shapes allows different shapes and buoyancy levels for different size users. For example, an average adult lifts each foot about seven inches during a running step. In contrast, a child, or a smaller adult, lifts each foot a lesser amount, and thus each ski must be sized accordingly. By altering the length, width, and depth of the ski, skis can be custom tailored to their user for optimized propulsion efficiency, speed, and comfort.

The result of the above is a ski that allows its user to walk or run along the water. The health benefits of cardiovascular exercise are well known. But an additional benefit is less obvious—given that water is a liquid, there is less rotational stability than running on land. As a result, the user must activate the secondary muscles of the feet, legs, and torso to maintain stability, which helps improve the user's balance.

While the disclosure within focuses on the use of the skis in water, they are equally usable in snow. The rising and falling motion that engages and disengages the traction paddles in water works equally well in snow.

Discussion will now turn to a specific embodiment of the disclosed device.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
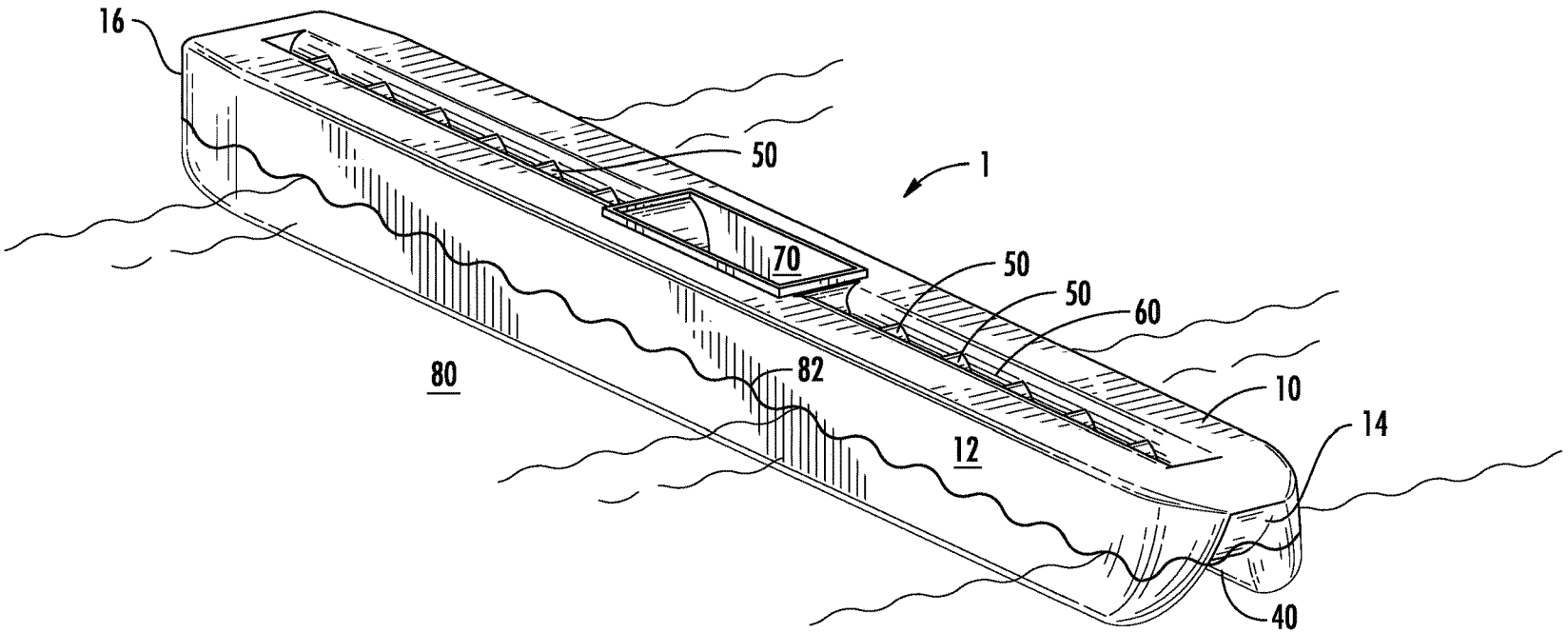
FIG. 1 illustrates an isometric view of a first embodiment of the device.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an isometric view of a first embodiment of the device is shown.

The tunnel hull ski 1 is shown in water 80. The water's surface 82 is shown against the second hull 12 of the tunnel hull ski 1. The first hull 10 is shown on the far side of the figure. Referring to the sides of the tunnel hull ski as first and second is arbitrary and used only for consistency in description.

For clarity, the figures show only a single ski. But for proper use two skis are required, one for each of the user's feet.

The ski front 14 includes a front scoop 40, into which incoming water 80 passes during use, passing out at the rear discharge 42 (not shown) at ski rear 16.

The upper ends of the traction paddles 50 are shown, visible through the air exhaust gap 60.

A portion of the foot well 70 is shown, ready to accept an adapter/boot 74 (not shown) to be worn by a user.

Figure 2:
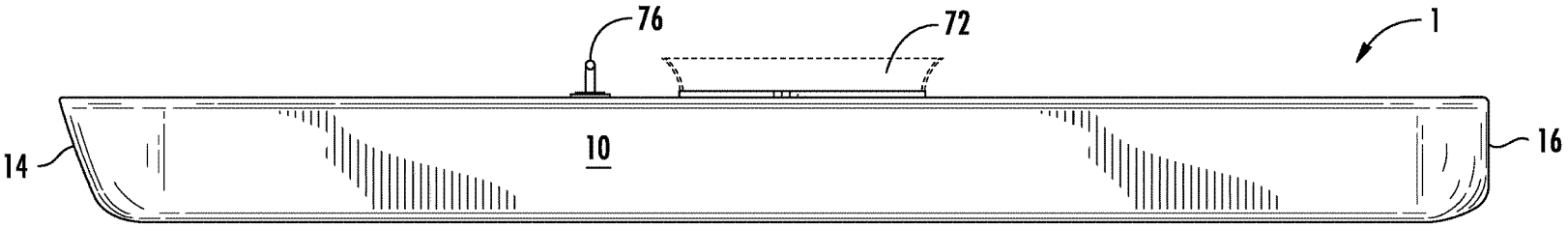
FIG. 2 illustrates a side view of the first embodiment of the device.

Referring to FIG. 2, a side view of the first embodiment of the device is shown.

First hull 10 of tunnel hull ski 1 is shown, with the ski front 14 and ski rear 16. Optional carry/mounting handle 76 is shown in front of the foot well 70 (not shown).

Figure 3:
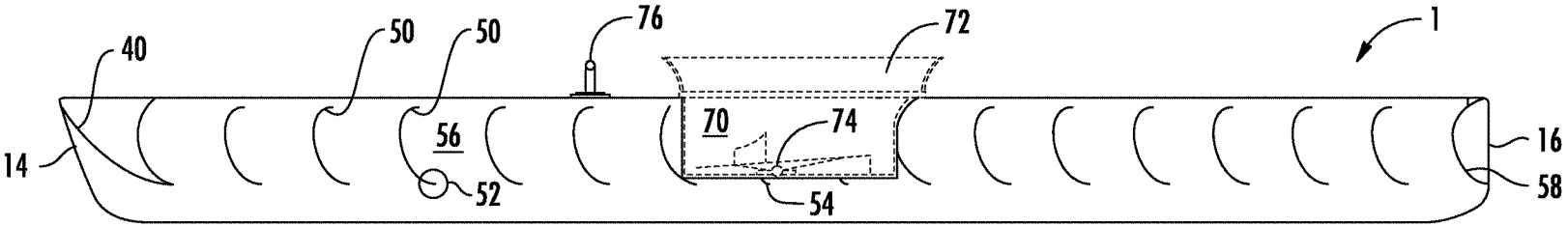
FIG. 3 illustrates a side view of the first embodiment of the device, rendered partially transparent to show the paddles.

Referring to FIG. 3, a side view of the first embodiment of the device is shown with the foreground hull rendered transparent to provide a view of the interior paddles.

The multiplicity of traction paddles 50 is shown, the space between each pair of traction paddles 50 forming compartments 56. The lower portion of each traction paddle 50 optionally includes a rearwardly curved tip 52 to minimize the rearward force of waves that enter the front of the tunnel hull ski 1.

The ski rear 16 includes a rear paddle 58 that is wider and taller than a typical traction paddle 50, but has a similar profile and performs the same function.

The foot well 70 optionally includes partial paddles 54, which are shorter in height due to the depth of the foot well 70.

An optional collar 72 is shown around the foot well 70, intended to minimize the introduction of water into the foot well 70 during use.

The foot adapter/boot 74 is shown within the foot well 70, which secures the user's foot to the foot well 70 during use.

Referring to FIG. 4, the cycle of the paddles moving in and out of the water during use of the device is illustrated via four phases.

Figure 4A:
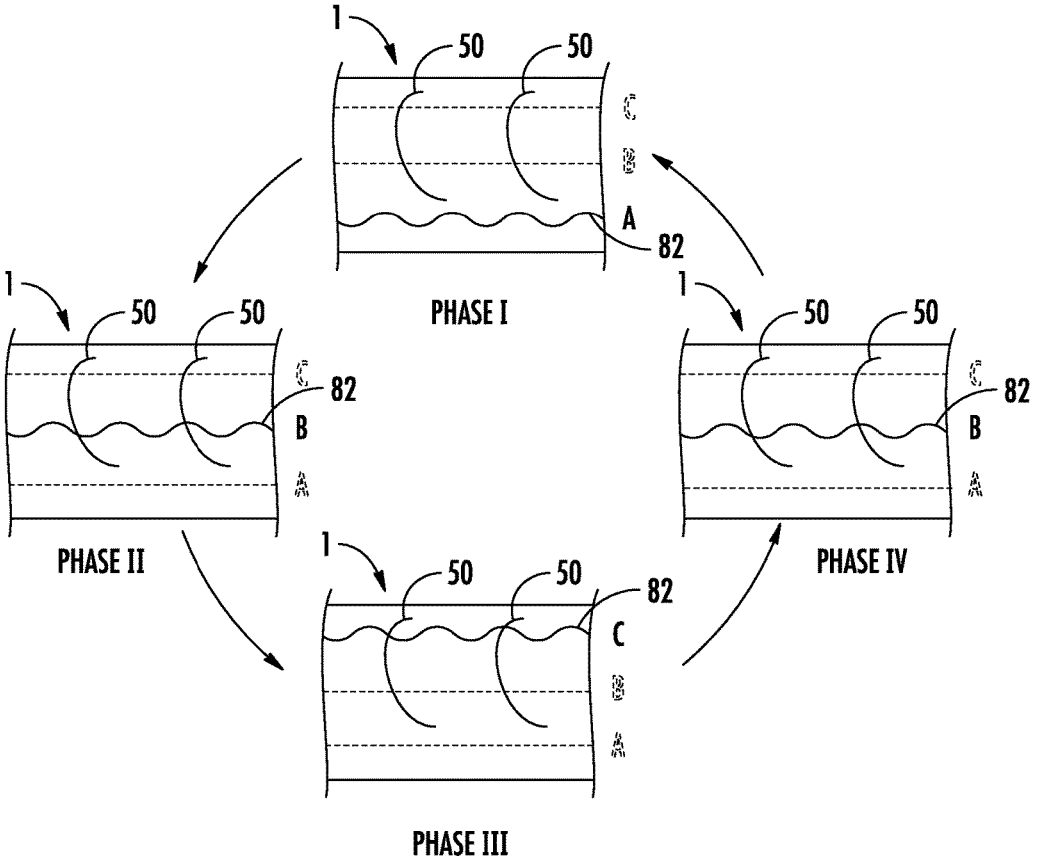
FIGS. 4A and 4B illustrate the cycle of the paddles moving in and out of the water during use of the device.
Figure 4B:
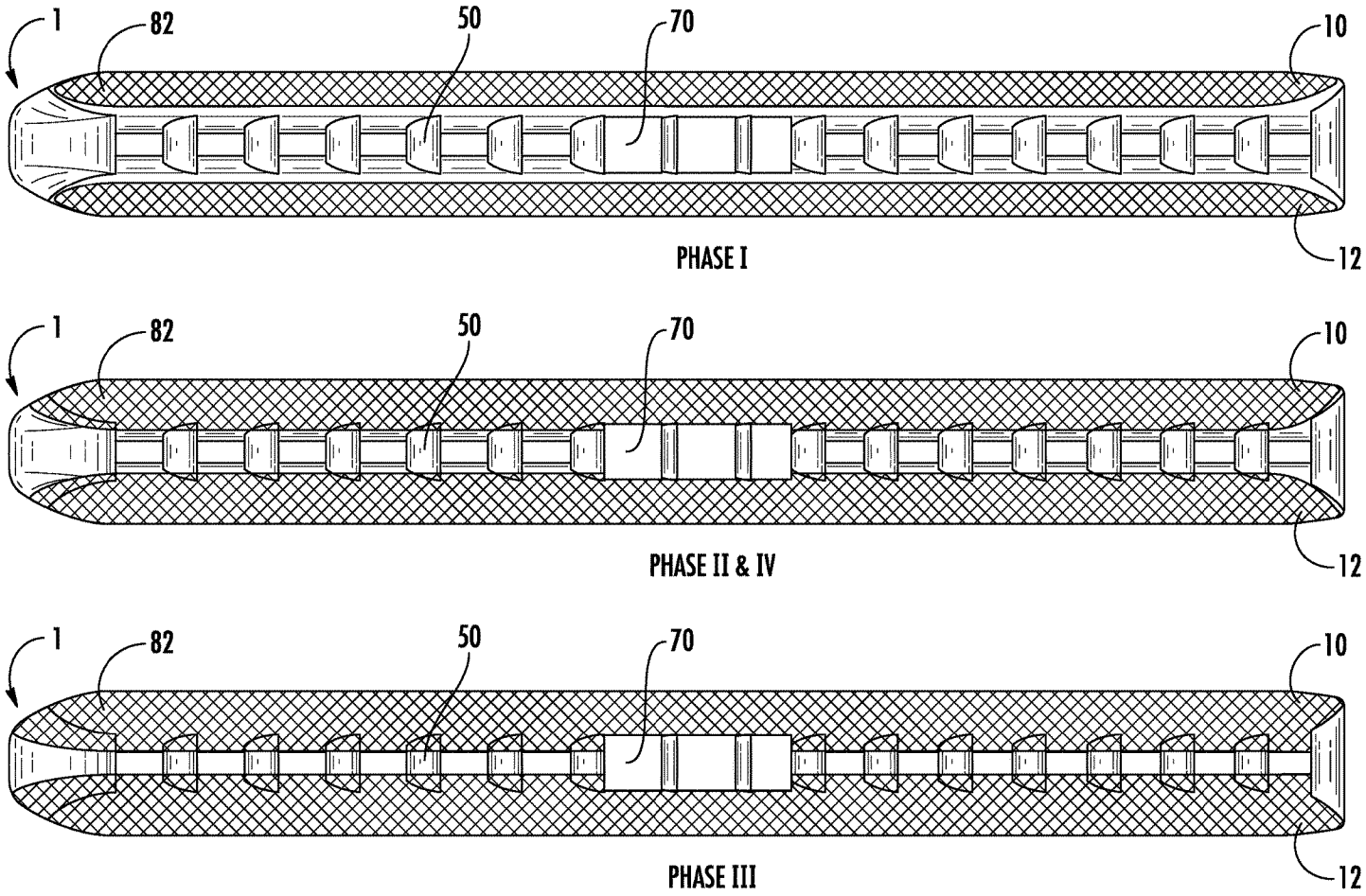

FIGS. 4A and 4B depict the relationship of traction paddles 50, and the water's surface 82, during the cycle of motion experienced by each tunnel hull ski 1. FIG. 4A shows a partial side view of the ski and depicts the waterline location during each phase in the movement cycle. FIG. 4B shows a bottom view of the ski with hatches indicating the area of ski hull that is submerged during each phase in the movement cycle.

The Phase I images depicts a ski 1 under minimal load, as when a user is lifting his foot to step forward. The ski 1 has risen with respect to the water 80 such that the water's surface 82 coincides with low-load waterline A. In this position the traction paddles 50 are above the water's surface, thus creating no resistance to forward motion. A small additional gap ideally exists between the lower tip of the traction paddle 50 and the water's surface 82, allowing small waves to pass.

The Phase II images depict a ski 1 under normal load, such as when the user is splitting his weight equally between his two feet. The ski descends into the water 80 such that the water's surface 82 coincides with the mid-load waterline B. The traction paddles 50 are partially engaged.

The Phase III images depict a ski 1 under full load. This occurs when the user has shifted substantially all his weight to his non-advancing leg—the leg he pushes from. With the user's full weight applied, the ski 1 descends into the water 80 such that the traction paddles 50 are nearly submerged in entirety beneath the water's surface 82. This is the power position, or fixed position, used to plant the non-advancing leg in the water to allow the user to lift and extend the advancing leg forward.

The Phase IV images again depicts a ski 1 under normal load.

During use of a pair of skis, this cycle repeats for each ski as the user strides to advance forward.

Figure 5:
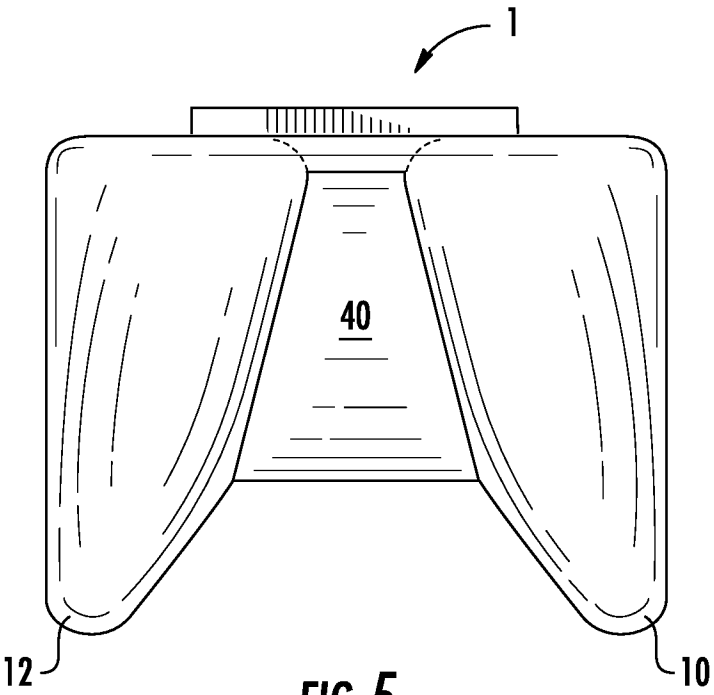
FIG. 5 illustrates a front view of the device.

Referring to FIG. 5, a front view of the device is shown, depicting the front of the tunnel hull ski 1. The front scoop 40 is shown, and the tapering frontal profile of each hull 10/12.

Figure 6:
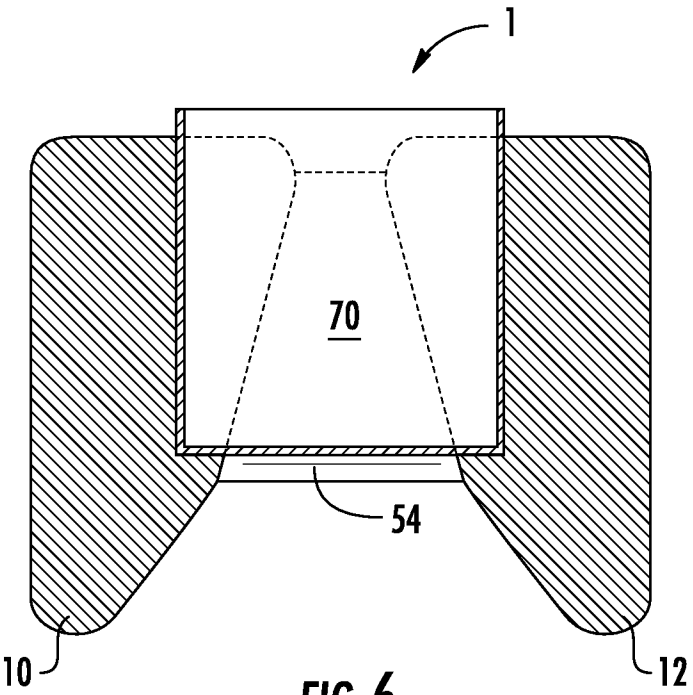
FIG. 6 illustrates a first cross-section of the device located at the foot well.

Referring to FIG. 6, a first cross-section of the device is shown. The cross-section of the foot well 70 is shown, with partial paddle 54 protruding from below.

Figure 7:
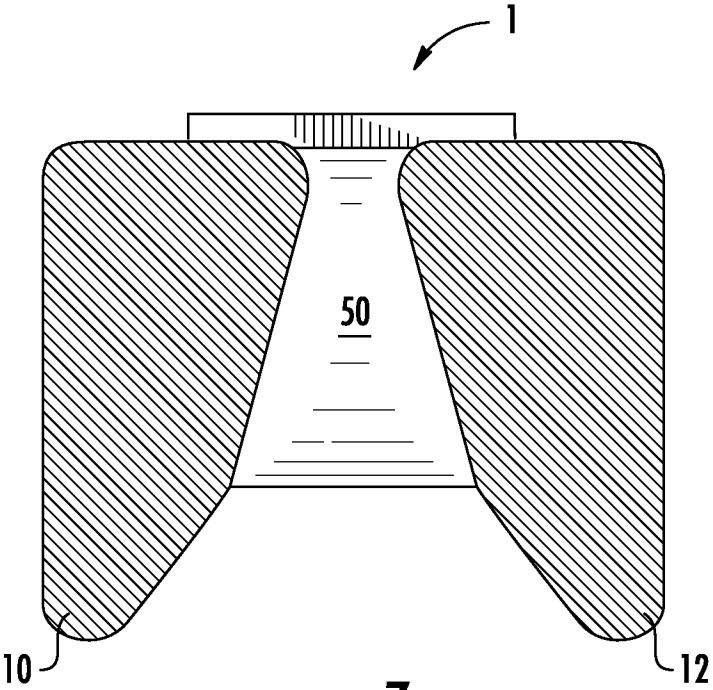
FIG. 7 illustrates a second cross-section of the device located just behind the foot well.

Referring to FIG. 7, a second cross-section of the device is shown. A traction paddle 50 is shown with its trapezoidal shape.

Figure 8:
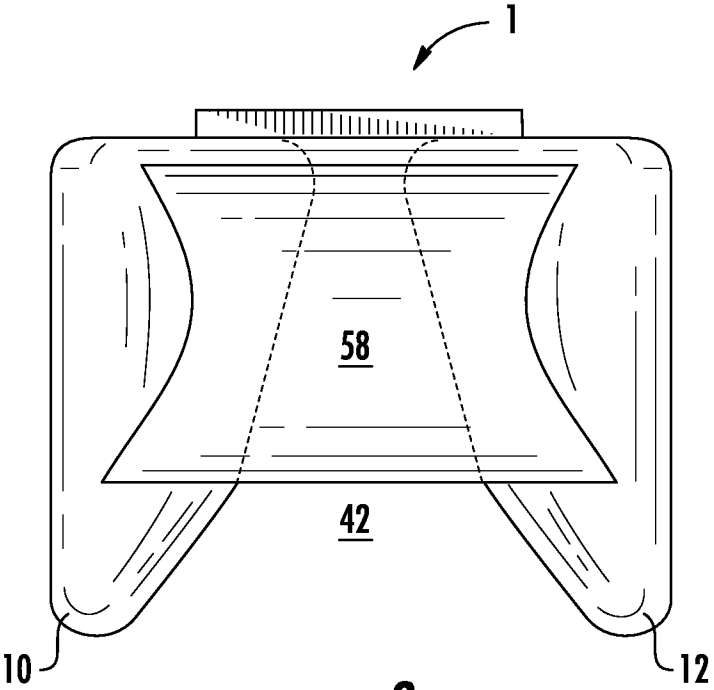
FIG. 8 illustrates a rear view of the device.

Referring to FIG. 8, a rear view of the device is shown, depicting the rear of the tunnel hull ski 1. The rear paddle 58 and rear discharge 42 is shown, and the tapering end of each hull 10/12.

Figure 9:
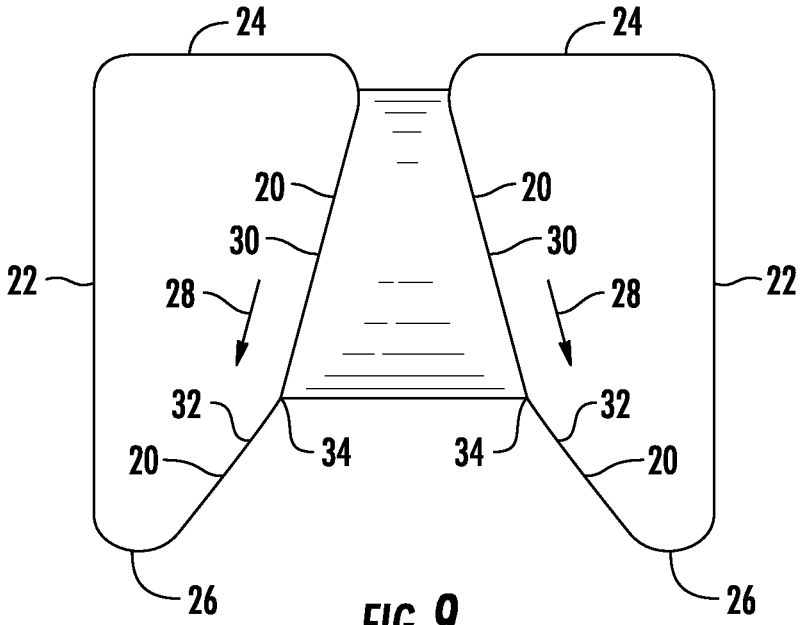
FIG. 9 illustrates a third cross-section of the device at a typical traction paddle.

Referring to FIG. 9, a generic cross-section of the device with its tapered profile is shown.

The profile of the first hull 10 and second hull 12 are important to operation of the tunnel hull ski.

Each hull 10/12 is made of numerous sides. Such sides include the inner wall 20, outer wall 22, and upper wall 24. The outer wall 22 and inner wall 20 meet at the curved tip 26.

The inwardly tapering shape is shown as the downward hull taper 28. In the preferred embodiment, the downward hull taper 28 has an upper section with a shallow taper 30, and a lower section with a steep taper 32. These two tapers meet at a taper transition point 34.

It is the tapering without reduction of the outer width that allows the tunnel hull skis 1 to minimize frontal cross-sectional area displacing water during the advancing step without reducing lateral stability.

Figure 10:
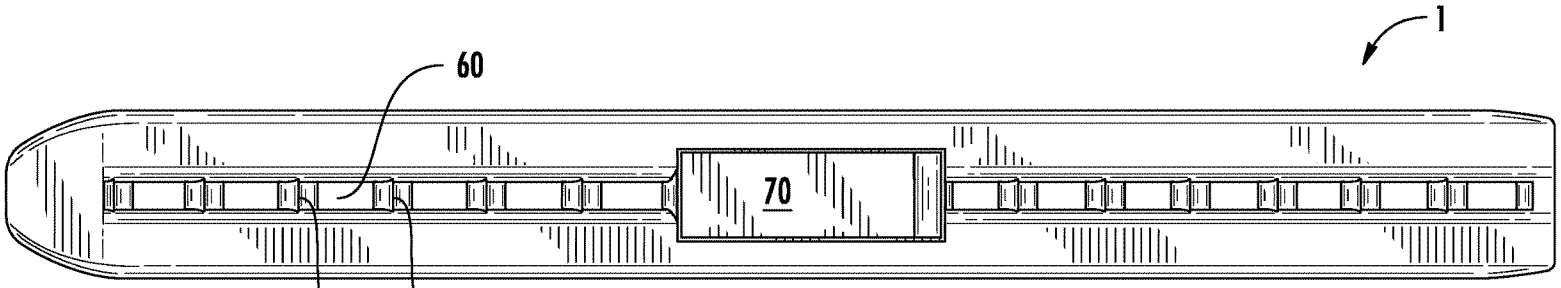
FIG. 10 illustrates a top view of the first embodiment of the device.

Referring to FIG. 10, a top view of the first embodiment of the device is shown. Each pair of traction paddles 50 has an air exhaust gap 60. The air exhaust gap 60 may be a continuous slot, or individual gaps associated with each compartment 56.

Figure 11:
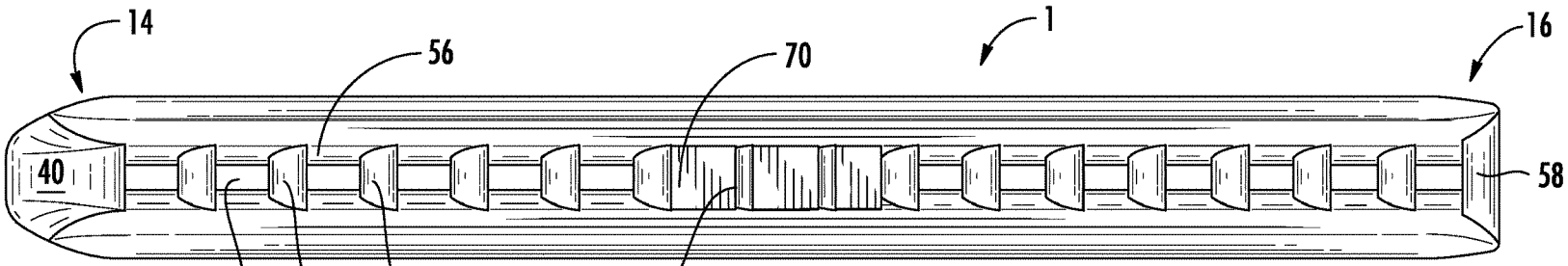
FIG. 11 illustrates a bottom view of the first embodiment of the device.

Referring to FIG. 11, a bottom view of the first embodiment of the device is shown. The compartments 56 formed by pairs of traction paddles 50 are shown. Without the air exhaust gap 60, one can see how air becomes trapped within the compartment, and inhibits the ability of the ski 1 to descend into the water 80.

Figure 12:
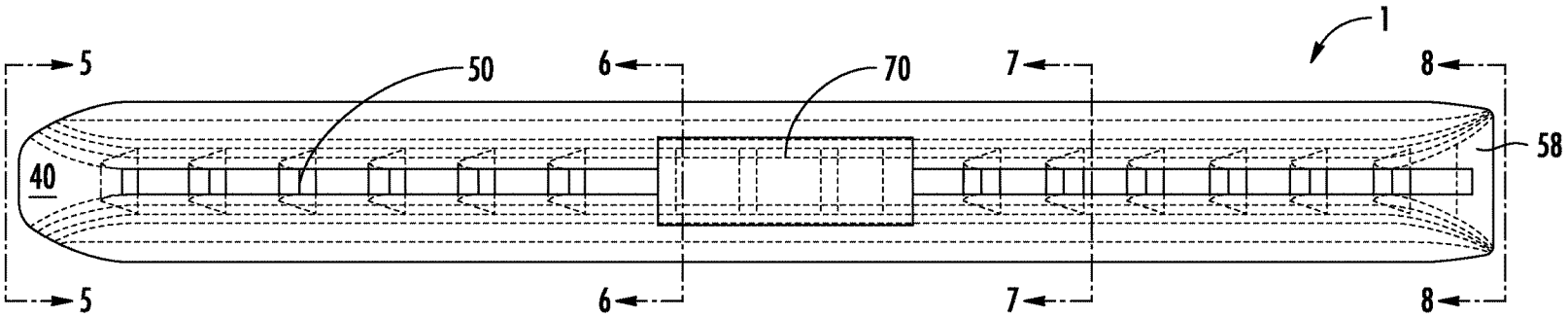
FIG. 12 illustrates a top transparent view of the device.

Referring to FIG. 12, a transparent top view of the device is shown. The tapering shapes of the front scoop 40 and rear paddle 58 are shown.

Also indicated are the cross-sections shown in FIGS. 6 and 7, the front view shown in FIG. 5, and the rear view shown in FIG. 8.

Figure 13:
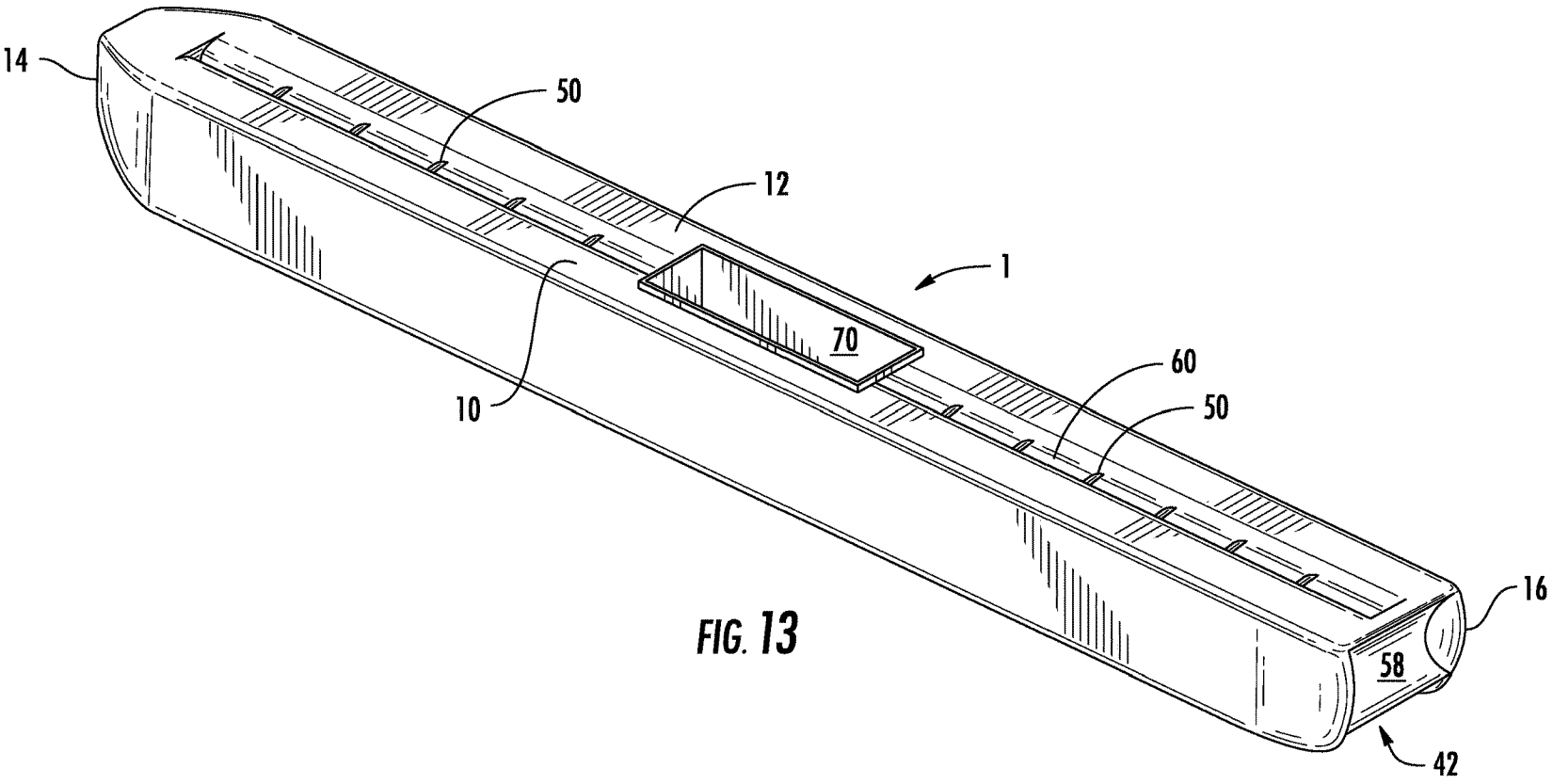
FIG. 13 illustrates a rear isometric view of the first embodiment of the device.

Referring to FIG. 13, a rear isometric view of the device is shown. The largest traction paddle 58 and discharge 42 are shown at the ski rear 16, bridging the first hull 10 and second hull 12. The upper ends of the traction paddles 50 are shown within the continuous air exhaust gap 60. Roughly midway between the ski front 14 and ski rear 16 sits the foot well 70.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A personal water propulsion device for use on a water surface, the device comprising:

a tunnel hull ski formed from two or more hulls, each hull having a cross-sectional shape, a top, and a bottom;

a multiplicity of fixed curved scoops affixed to the two or more hulls, the multiplicity of fixed curved scoops substantially along a centerline of the tunnel hull ski;

a compartment formed by each adjacent pair of fixed curved scoops of the multiplicity of fixed curved scoops; and one or more air exhaust gaps at the top of each of the two or more hulls of the tunnel hull ski;

whereby the one or more air exhaust gaps allow air to escape from each compartment as the tunnel hull ski descends into the water, thus permitting water to flow in-between the fixed curved scoops.

2. The personal water propulsion device of claim 1, wherein the cross-sectional shape of each hull is substantially a right triangle.

3. The personal water propulsion device of claim 1, wherein the cross-sectional shape of each hull tapers toward the bottom of each hull to form a downward hull taper.

4. The personal water propulsion device of claim 1, wherein each fixed curved scoop has a cupped shape.

5. The personal water propulsion device of claim 1, wherein each fixed curved scoop includes a lower tip, the lower tip angled toward a rear of the tunnel hull ski.

6. The personal water propulsion device of claim 1, wherein the one or more gaps are unobstructed, allowing air to freely flow into and out of the compartments.

7. The personal water propulsion device of claim 1, wherein the one or more air exhaust gaps are sized to limit the rate at which air is permitted to flow out of the compartments, thereby limiting the rate at which the device will descend into the water.

8. A device for moving across water, the device comprising:

a left water ski and a right water ski;

the left water ski and the right water ski each having a cross-sectional shape, the first hulls and the second hulls being triangular, and a plurality of fixed curved scoops affixed between the first hull and second hull of each ski, the plurality of fixed curved scoops having a convex side facing forward;

one or more air penetrations that allow air to flow out of a space between any two fixed curved scoops;

whereby as a user shifts weight from the left water ski to the right water ski, the left water ski rises, lifting the left plurality of fixed curved scoops out of the water, allowing the left water ski to glide forward, and correspondingly causing the plurality of fixed curved scoops of the right water ski to sink into the water, allowing the user to push off using the right ski.

9. The device for moving across water of claim 8, wherein the cross-sectional shape of each hull is substantially a right triangle.

10. The device of claim 9 wherein a 90-degree corner of the right triangle is placed at a top and outside corner of each hull.

11. The device for moving across water of claim 8, wherein the cross-sectional shape of each hull tapers toward the bottom to form a downward hull taper.

12. The device for moving across water of claim 8, wherein each fixed curved scoop includes a lower tip, the lower tip angled toward a rear of the tunnel hull ski.

13. The device for moving across water of claim 8, wherein the one or more air penetrations are unobstructed, allowing air to freely flow into and out of the compartments.

14. The device for moving across water of claim 8, wherein the one or more air penetrations are undersized to throttle the flow of air, limiting the flow, and thereby limiting the rate at which the device will enter the water.

15. A device for self-propulsion across water or snow, the device comprising:

two hulls;

each hull having a length and a width;

the two hulls in a fixed position with respect to each other;

the hulls having a space between each other, the space forming a tunnel along the entire length of the hulls;

a multiplicity of fixed curved scoops;

the multiplicity of fixed curved scoops affixed to the hulls;

the multiplicity of fixed curved scoops within the tunnel formed by the hulls;

whereby the rising and falling motion of the two hulls causes the multiplicity of fixed curved scoops to engage and disengage with the water or snow, thus adapted to allow a user to move forward across a surface of water or snow.

16. The device for self-propulsion of claim 15, the device further comprising:

air exhaust gaps;

the air exhaust gaps allowing air to enter and exit a space created by the hulls and fixed curved scoops;

thereby permitting the device to descend into the water or snow without being inhibited by trapped air.

17. The device for self-propulsion of claim 15, the device further comprising:

air flow control orifices;

the air flow control orifices allowing air to enter and exit a space created by the hulls and fixed curved scoops at a speed dictated by an orifice size;

whereby smaller air flow control orifices limit air flow, thus slowing the speed at which the device will enter the water or snow, and larger air flow control orifices allow greater air flow, thus increasing the speed at which the device will enter the water or snow.

18. The device for self-propulsion of claim 15, wherein each of the fixed curved scoops is substantially C-shaped, with the concave portion of the C-shape facing a rear of the tunnel.

19. The device for self-propulsion of claim 15, wherein each fixed curved scoop includes a bottom tip, the bottom tip of each paddle being slanted toward a rear of the tunnel.

20. The device for self-propulsion of claim 15, wherein:

each hull is substantially an upside down right triangle, and a 90-degree angle of each upside down right triangle is located at an upper outside corner of each hull.

* * * * *